US008057975B2

(12) United States Patent
Nishimura

(10) Patent No.: US 8,057,975 B2
(45) Date of Patent: Nov. 15, 2011

(54) ELECTROPHOTOGRAPHIC PHOTORECEPTOR AND IMAGE FORMING APPARATUS HAVING SAME

(75) Inventor: Kazuto Nishimura, Higashiomi (JP)

(73) Assignee: Kyocera Corporation, Shi-Kyoto (JP)

( * ) Notice: Subject to any disclaimer, the term of this patent is extended or adjusted under 35 U.S.C. 154(b) by 1083 days.

(21) Appl. No.: 11/896,186

(22) Filed: Aug. 30, 2007

(65) Prior Publication Data

US 2008/0056763 A1 Mar. 6, 2008

(30) Foreign Application Priority Data

Aug. 31, 2006 (JP) ..... 2006-236033

(51) Int. Cl.
*G03G 5/10* (2006.01)

(52) U.S. Cl. ..... 430/69; 430/56; 399/159; 399/176

(58) Field of Classification Search ..... 399/159, 399/176; 430/56, 69

See application file for complete search history.

(56) References Cited

U.S. PATENT DOCUMENTS

| | | | | |
|---|---|---|---|---|
| 3,984,183 | A * | 10/1976 | Maksymiak | 399/313 |
| 4,045,134 | A * | 8/1977 | Suzuki et al. | 399/159 |
| 5,415,961 | A * | 5/1995 | Yu et al. | 430/58.05 |
| 5,709,765 | A * | 1/1998 | Herbert et al. | 156/293 |
| 5,983,043 | A | 11/1999 | Ohwaki et al. | |
| 6,226,479 | B1 * | 5/2001 | Karaki et al. | 399/159 |
| 6,815,135 | B2 * | 11/2004 | Morikawa et al. | 430/66 |
| 7,151,904 | B2 * | 12/2006 | Narita et al. | 399/159 |
| 7,197,259 | B2 * | 3/2007 | Ohshika | 399/103 |
| 7,316,876 | B2 * | 1/2008 | Kobayashi | 430/60 |
| 7,517,629 | B2 * | 4/2009 | Kobayashi et al. | 430/119.71 |
| 7,751,754 | B2 * | 7/2010 | Nakano | 399/159 |
| 2002/0051654 | A1 * | 5/2002 | Niimi et al. | 399/159 |
| 2003/0190547 | A1 * | 10/2003 | Kobayashi et al. | 430/125 |
| 2006/0140648 | A1 * | 6/2006 | Takegawa | 399/12 |
| 2007/0231719 | A1 * | 10/2007 | Nishimura | 430/56 |

FOREIGN PATENT DOCUMENTS

| | | | |
|---|---|---|---|
| EP | 2230558 | A2 * | 9/2010 |
| JP | 63-58242 | | 4/1988 |
| JP | 06-337534 | | 12/1994 |
| JP | 07-210029 | | 8/1995 |
| JP | H7-38920 | | 9/1995 |
| JP | 08-095275 | | 4/1996 |
| JP | 08095275 | A * | 4/1996 |
| JP | 08-146632 | | 6/1996 |
| JP | 08-160809 | | 6/1996 |
| JP | 08160714 | A * | 6/1996 |
| JP | 08-234540 | | 9/1996 |

(Continued)

OTHER PUBLICATIONS

Definition of "annular". <<http://www.merriam-webster.com/dictionary/annular>> retrieved on Jul. 29, 2010.*

(Continued)

*Primary Examiner* — Christopher Rodee
(74) *Attorney, Agent, or Firm* — Bacon & Thomas, PLLC

(57) ABSTRACT

An electrophotographic photoreceptor includes a cylindrical body and a film forming layer formed on an outer surface of the cylindrical body, having a photosensitive layer. The electrophotographic photoreceptor is divided into a first region where an electrostatic latent image is formed and second regions provided at both end portions in an axial direction of the cylindrical body. The second regions include inclined annular surfaces whose outer diameters decrease toward end portions in the axial direction.

3 Claims, 8 Drawing Sheets

FOREIGN PATENT DOCUMENTS

| | | | | |
|---|---|---|---|---|
| JP | 08314159 | A | * | 11/1996 |
| JP | 09015998 | A | * | 1/1997 |
| JP | 10-063141 | | | 3/1998 |
| JP | 10-063142 | | | 3/1998 |
| JP | 10198058 | A | * | 7/1998 |
| JP | 10240001 | A | * | 9/1998 |
| JP | 10-288916 | | | 10/1998 |
| JP | 11-184176 | | | 7/1999 |
| JP | 11305573 | A | * | 11/1999 |
| JP | 2000284510 | A | * | 10/2000 |
| JP | 2005-250507 | | | 9/2005 |
| JP | 2006-201228 | | | 8/2006 |

OTHER PUBLICATIONS

Definition of "inclined". <<http://www.merriam-webster.com/dictionary/inclined>> retrieved on Jul. 29, 2010.*

Engllish language machine translation of JP 08-141159 (Nov. 1996).*

* cited by examiner

ELECTROPHOTOGRAPHIC PHOTORECEPTOR AND IMAGE FORMING APPARATUS HAVING SAME

CROSS-REFERENCE TO RELATED APPLICATIONS

The present application claims priority of Japanese Patent Application No. 2006-236033, filed on Aug. 31, 2006. The contents of this application are incorporated herein by reference in their entirety.

BACKGROUND OF THE INVENTION

1. Field of the Invention

The present invention relates to an electrophotographic photoreceptor including a cylindrical body and a film forming layer formed on an outer surface thereof, having a photosensitive layer. The present invention also relates an image forming apparatus having the electrophotographic photoreceptor.

2. Description of the Related Art

An image forming apparatus such as an electrophotographic copying machine or printer has an electrophotographic photoreceptor and a plurality of processing devices such as a charging device, an exposure device, a development device, a transfer device, a cleaning device and a discharging device, wherein each of them performs a corresponding operation on the electrophotographic photoreceptor and is required for an image formation using the electrophotographic photoreceptor. If an appropriate positional relationship between the processing devices and the electrophotographic photoreceptor is not maintained, it is not difficult to form a required image. Especially, in cases of the charging device and the development device, higher positional accuracies are required in respective distances to the electrophotographic photoreceptor or in respective relative positions thereto along an axial direction of the electrophotographic photoreceptor.

FIGS. 8 and 9 illustrate examples of a conventional method for determining a positional relationship between the electrophotographic photoreceptor and the processing device.

In the example shown in FIG. 8, a processing device 3' such as a charger or the like is supported by a housing 37' and, also, a bearing 38' for rotatably supporting a rotation axis 28' of an electrophotographic photoreceptor 2' is provided at both end portions of the housing 37'. The processing device 3' is provided with rollers 39' that can rotate while being in contact with an outer surface of the electrophotographic photoreceptor 2'. Further, in the example shown in FIG. 8, an appropriate distance between the electrophotographic photoreceptor 2' and the processing device 3' can be maintained during the rotation of the electrophotographic photoreceptor 2' due to the presence of rollers 39' that can rotate while being in contact with the outer surface of the electrophotographic photoreceptor 2'.

Meanwhile, in the example shown in FIG. 9, an electrophotographic photoreceptor 2" has both end portions of tapered shapes in which respective diameters increase gradually toward the end portions, and butting rollers 59" of a processing device (development device) 5" are made to rotate while being in contact with tapered portions 29" (see, e.g., Japanese Patent Laid-open Application No. H10-63142). Moreover, in the example shown in FIG. 9, the diameters of the tapered portions 29" increase gradually toward the end portions, so that the butting rollers 59" can be prevented from being misaligned with respect to the axial direction of the electrophotographic photoreceptor 2". As a result, it is possible to maintain an appropriate distance between the electrophotographic photoreceptor 2" and the processing device (development device) 5" and further to avoid the misalignment in its position along the axial direction.

However, in the example shown in FIG. 8, the processing device 3', e.g., a charger or the like, and the electrophotographic photoreceptor 2' (rotation axis 28') need to be positioned and supported with respect to the housing 37'; the rollers 39' of the processing device 3' need to be positioned and supported with respect to the processing device 3'; and the housing 37' itself needs to be positioned and supported. As a consequence, it is not easy to maintain an appropriate positional relationship between the electrophotographic photoreceptor 2' and the processing device 3'. Besides, in order to improve the positional accuracy, the cost required for the positioning increases. If the housing 37' is used for the positioning, a space for the housing 37' is required, which scales up the apparatus.

Meanwhile, in the example shown in FIG. 9, the butting rollers 59" of the processing device (development device) 5" are made to rotate while being in contact with the tapered portions of the electrophotographic photoreceptor 2", so that the positional accuracy can be improved with a simple structure and at a low cost. On the other hand, impurities such as abrasive particles and the like can be produced from the electrophotographic photoreceptor 2" or the butting rollers 59" due to friction, contact rotation or the like between the tapered portions 29" of the electrophotographic photoreceptor 2" and the butting rollers 59". In that case, since the tapered portions 29" are formed so that the diameters decrease gradually toward a central portion (latent image forming region) of the electrophotographic photoreceptor 2', the impurities such as abrasive particles and the like can easily be dispersed to be left in the latent image forming region. When the impurities are dispersed to be left in the latent image forming region, they are adhered to the latent image forming region, thereby deteriorating quality of the image.

SUMMARY OF THE INVENTION

It is, therefore, an object of the present invention to reduce a deterioration in a quality of an image by preventing impurities from being dispersed to be left in a latent image forming region of the electrophotographic photoreceptor while maintaining an appropriate positional relationship between the electrophotographic photoreceptor and the processing device with a simple structure and at a low cost without scaling up an apparatus, the impurities being generated by friction or the like between a processing device and an electrophotographic photoreceptor.

In accordance with a first aspect of the present invention, an electrophotographic photoreceptor comprises a cylindrical body and a film forming layer formed on an outer surface of the cylindrical body, having a photosensitive layer. The electrophotographic photoreceptor is divided into a first region where an electrostatic latent image is formed and second regions provided at both end portions in an axial direction of the cylindrical body. The second regions include inclined annular surfaces whose outer diameters decrease toward end portions in the axial direction.

BRIEF DESCRIPTION OF THE DRAWINGS

The above and other objects and features of the present invention will become apparent from the following description of embodiments, given in conjunction with the accompanying drawings, in which.

DETAILED DESCRIPTION OF THE EMBODIMENT

Hereinafter, an image forming apparatus and an electrophotographic photoreceptor in accordance with embodiments of the present invention will be described in detail with reference to the accompanying drawings.

Figure 1:
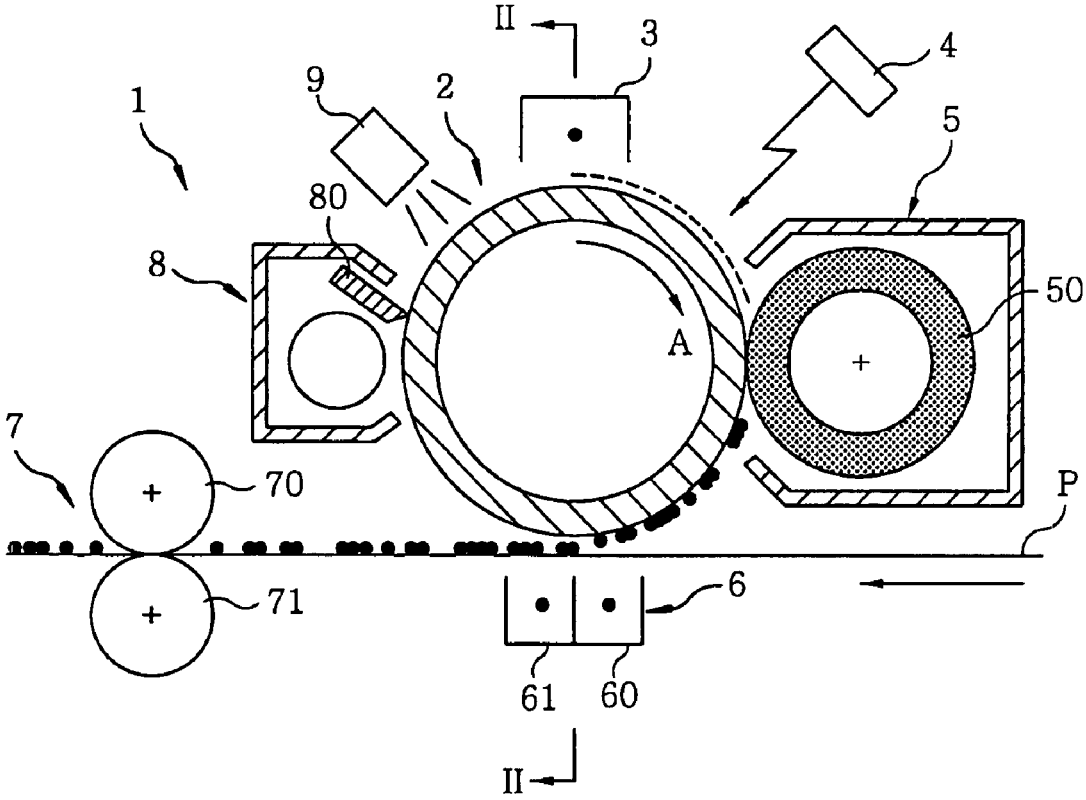
FIG. 1 schematically illustrates an example of an image forming apparatus in accordance with the present invention.

An image forming apparatus 1 illustrated in FIG. 1 employs the Carlson method for an image formation, and includes an electrophotographic photoreceptor 2, a charging device 3, an exposure device 4, a development device 5, a transfer device 6, a fixing device 7, a cleaning device 8 and a discharging device 9.

Figure 2:
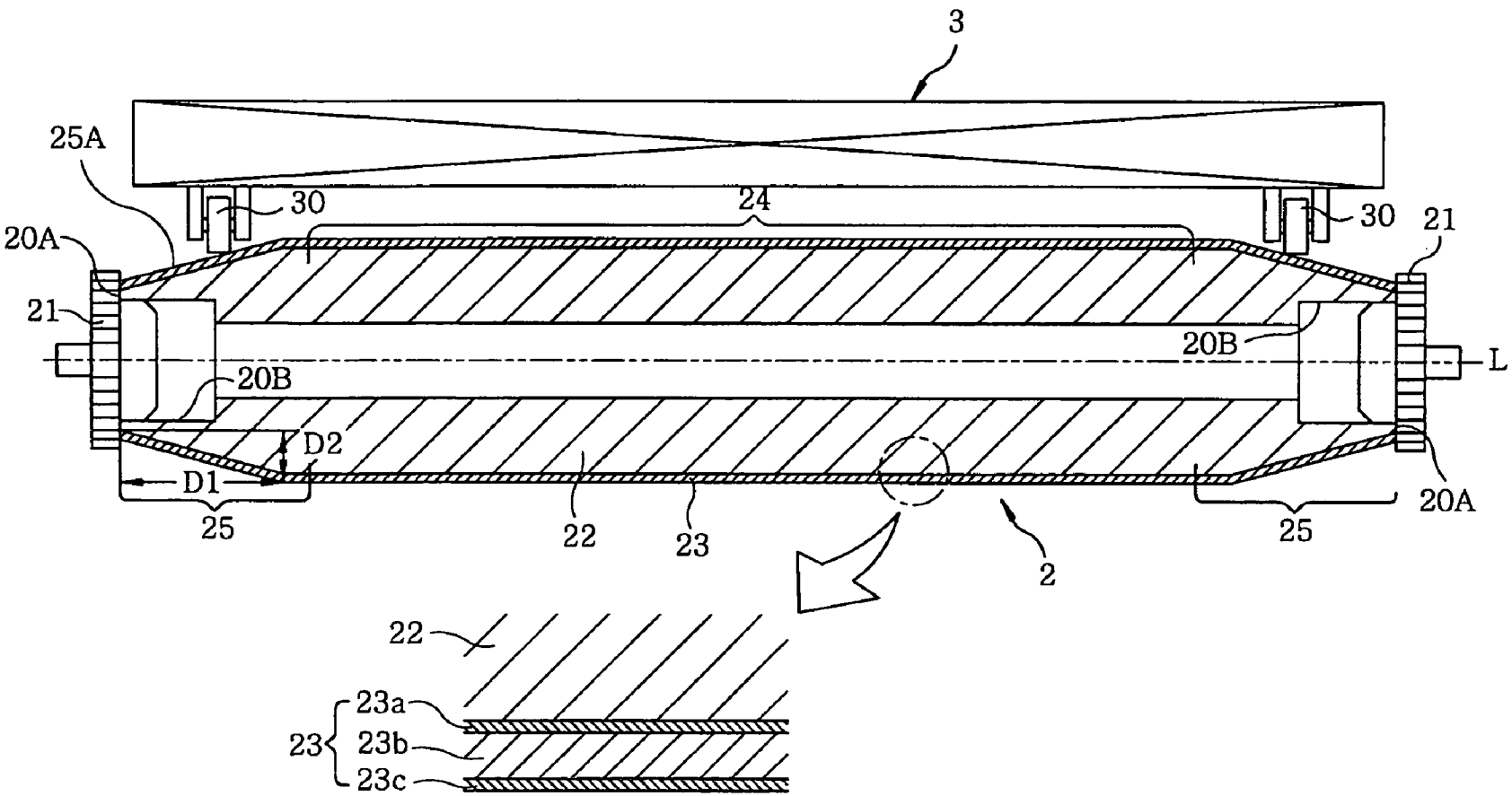
FIG. 2 illustrates a cross sectional view taken along line II-II shown in FIG. 1.

The electrophotographic photoreceptor 2 forms a latent image and a toner image based on image signals, and can rotate in a direction of an arrow A illustrated in FIG. 1. As illustrated in FIG. 2, the electrophotographic photoreceptor 2 includes a cylindrical body 22 having on an outer peripheral surface thereof a film forming layer 23. The electrophotographic photoreceptor 2 is divided into a first region 24 where the latent image is formed; and second regions 25 provided at both end portions in an axial direction L, each being continuously extended from the end of the first region 24.

The first region 24 has a substantially constant diameter, whereas the second regions 25 are formed in a tapered shape in which respective diameters decrease gradually toward end surfaces 20A. Accordingly, the second regions 25 have inclined annular surfaces 25A where respective diameters of cross sections thereof decrease gradually toward the end surfaces 20A. The inclined annular surfaces 25A are made to contact with rollers 30 of the charging device 3 to be described later. Here, a dimension D1 in the axial direction L is set to range from about 50 mm to about 100 mm, and a height difference D2 is set to range from about 10 μm to about 100 μm.

The cylindrical body 22 is central to the electrophotographic photoreceptor 2 and is conductive at least on its surface. In other words, the cylindrical body 22 may be made of a conductive material as a whole, or may be made of an insulating material having a conductive film formed thereon. Preferably, the cylindrical body 22 is formed of an Al alloy material as a whole. In this way, the electrophotographic photoreceptor 2 of a light weight can be manufactured at a low cost. Further, the adhesion between the cylindrical body 22 and a carrier injection blocking layer 23*a* of the film forming layer 23 and between the cylindrical body 22 and a photoconductive layer 23*b* of the film forming layer 23 is reliably enhanced when forming the carrier injection blocking layer 23*a* and the photo-conductive layer 23*b* by an amorphous silicon based (a-Si based) material.

The cylindrical body 22 has spigot joint portions 20B for allowing flanges 21 to be insertion-fitted into both end portions thereof. Further, each of the end portions of the cylindrical body 22 (corresponding to the second regions 25 of the electrophotographic photoreceptor 2) is formed in a tapered shape. The flanges 21 are used to apply rotation force to the electrophotographic photoreceptor 2. Since each of the end portions of the cylindrical body 22 is formed in a tapered shape, the film forming layer 23 is formed in a similar shape thereto. Accordingly, each of the end portions of the electrophotographic photoreceptor 2 (the second regions 25) is of a tapered shape and, hence, the electrophotographic photoreceptor 2 has the inclined annular surfaces 25A.

As will be described hereinafter with reference to FIGS. 3A and 3B, such shaped inclined annular surfaces 25A can be formed by performing a surface treatment: such as cutting, grinding or the like on the outer surface of the cylindrical body 22.

Figure 3A:
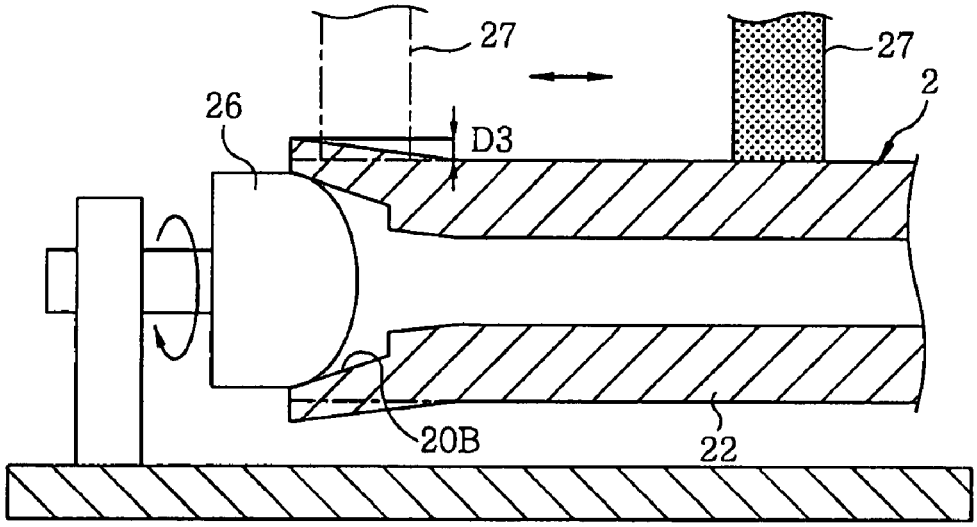
FIGS. 3A and 3B illustrate cross sectional views of principal parts to explain a method for forming tapered portions of a cylindrical body in an electrophotographic photoreceptor, respectively.

To begin with, the cylindrical body 22 is installed in the apparatus by inserting rotating jigs 26 into the spigot joint portions 20B of the cylindrical body 22, as illustrated in FIG. 3A. Each of the rotating jigs 26 has an outer diameter greater than an inner diameter of the corresponding spigot joint portion 20B. Therefore, when the rotating jigs 26 are inserted into the spigot joint portions 20B, outer surfaces of portions corresponding to the spigot joint portions 20B (both end portions) are pressed to be widened outwardly and are protruded compared to other portions. In that state, a machining or a grinding operation is performed on the cylindrical body 22 by using a machining tool 27 or the like to flatten the protruded portions. Accordingly, both of the end portions of the cylindrical body 22 which are pressed to be widened by the rotating jigs 26 have the same surface level as the outer surfaces of the overall cylindrical body 22.

Figure 3B:
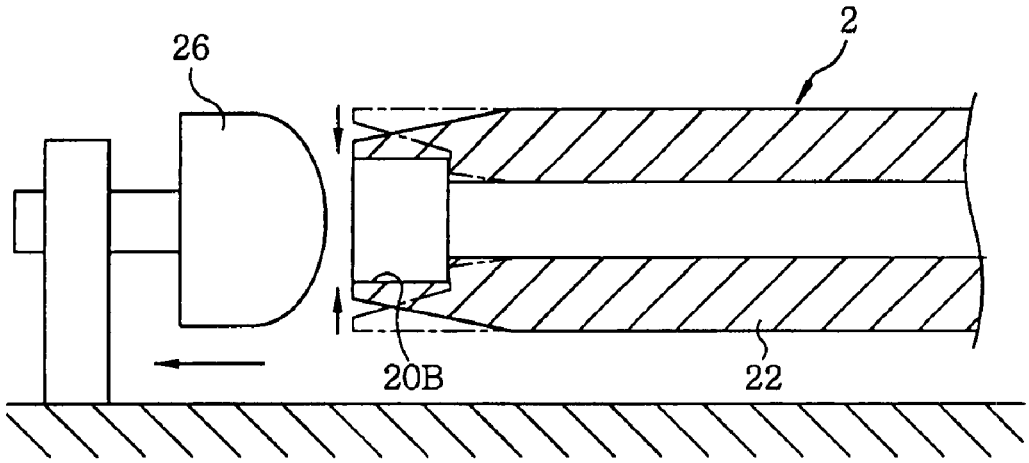

When the rotating jigs 26 are separated from the cylindrical body 22, both of the end portions of the cylindrical body 22 are elastically restored, as can be seen from FIG. 3B. As a result, each of the end portions of the cylindrical body 22 is restored to become of a tapered shape having a diameter that is smaller than the other portions.

When the cylindrical body 22 is made of, e.g., aluminum, a thickness of each of the portions corresponding to the spigot joint portions 20B needs to range from, e.g., about 1 mm to about 5 mm, and a dimension D3 obtained when each of the end portions of the cylindrical body 22 is widened by the corresponding rotating jig 26 needs to range from, e.g., about 10 μm to about 500 μm, so that both of the end portions of the cylindrical body 22 can be ensured to be elastically restored after the separation of the rotating jigs 26.

The cutting or the grinding performed on the cylindrical body 22 is a general process for smoothing the surface roughness or the like. After each of the end portions of the cylindrical body 22 is formed in a tapered shape through the cutting or the grinding of the cylindrical body 22, the inclined annular surfaces 25A can be formed at both end portions of the electrophotographic photoreceptor 2 by performing the conventional process for forming the film forming layer 23 on the cylindrical body 22. As set forth above, in the case of using the method described with reference to FIGS. 3A to 3B, the inclined annular surfaces 25A can be formed simply by performing the surface treatment process required for manufacturing the cylindrical body 22. Thus, it is possible to suppress the deterioration in work performance or the increase in a manufacturing cost in forming the inclined annular surfaces 25A.

It is preferable that each end portion of the cylindrical body 22 be already made of a tapered shape before forming the electrophotographic photoreceptor 2. The tapered shape thereof can also be formed by using another method other than the aforementioned method. For example, the tapered end portions of the electrophotographic photoreceptor 2 can be formed by obliquely machining the outer peripheral surface of the cylindrical body 22 with the use of the machining tool 27 without widening the spigot joint portions 20B.

As illustrated in FIG. 2, the film forming layer 23 has a structure in which the carrier injection blocking layer 23*a*, the photo-conductive layer 23*b* and a surface layer 23*c* are laminated in that order.

The carrier injection blocking layer 23*a* effectively prevents electrons or positive holes from the cylindrical body 22 from being injected into the photo-conductive layer 23*b*. Various types of the carrier injection blocking layer 23*a* may be used depending on the material of the photo-conductive layer 23*b*. When the photo-conductive layer 23*b* is made of an a-Si based material, the carrier injection blocking layer 23*a* is preferably made of the a-Si based material. In this way, electrophotographic device characteristics of enhanced adhesiveness between the cylindrical body 22 and the photo-conductive layer 23*b* can be obtained.

In forming the carrier injection blocking layer 23*a* of the a-Si material, the material may contain a thirteenth or a fifteenth group element of the periodic system in an amount larger than those contained in the photo-conductive layer 23*b* of the a-Si material so as to adjust the conductivity. Further, a large amount of C, N, O or the like may be also contained so as to have high resistivity.

In the photo-conductive layer 23*b*, electrons are excited by a laser irradiation from the exposure device 4, and a carrier of free electrons or positive holes is generated. The photo-conductive layer 23*b* is formed of an a-Si material, for example. As for the a-Si material, there may be used a-Si, a-SiC, a-SiN, a-SiO, a-SiGe, a-SiCN, a-SiNO, a-SiCO, a-SiCNO or the like. When the photo-conductive layer 23*b* is made of the a-Si based material, it is possible to obtain the enhanced electrophotographic device characteristics having high luminous sensitivity, high-speed responsiveness, stable repeatability, high heat resistance, high endurance and the like. Further, when the surface layer 23*c* is made of a-SiC:H, conformity of the photo-conductive layer 23*b* with the surface layer 23*c* is enhanced. The photo-conductive layer 23*b* may be made of not only an a-Si based alloy material in which an element such as C, N, O or the like is added to an a-Si based material, but also an a-Se based material such as a-Se, Se—Te, $As_2Se_3$ or the like.

Here, the thickness of the photo-conductive layer 23*b* is appropriately set depending on photo-conductive materials being used and desired electrophotographic device characteristics. In the case of using the a-Si based material, the thickness is generally set to range from 5 μm to 100 μm, and preferably from 15 μm to 80 μm.

The surface layer 23*c* is laminated on the surface of the photo-conductive layer 23*b* to suppress the friction and the abrasion of the photo-conductive layer 23*b*. The surface layer 23*c* is formed of, e.g., a-Si based material such as a-SiC or the like, with a film thickness ranging from 0.2 μm to 1.5 μm.

In the electrophotographic photoreceptor 2, the carrier injection blocking layer 23*a* may be replaced with a long-wavelength light absorbing layer. The long-wavelength light absorbing layer effectively prevents an exposure light, which is the long-wavelength light, from reflecting on the surface of the cylindrical body 22. Accordingly, generation of a fringe pattern at a formed image can be effectively prevented. Besides, in the electrophotographic photoreceptor 2, a carrier excitation layer for increasing luminous sensitivity can be provided between the photo-conductive layer 23*b* and the surface layer 23*c*.

The charging device 3 illustrated in FIGS. 1 and 2 charges the surface of the electrophotographic photoreceptor 2 positively or negatively at a voltage ranging from about 200 V to about 1000 V depending on the type of the photo-conductive layer of the electrophotographic photoreceptor 2. The charging device 3 is configured as, e.g., a corotron for corona discharge. Such charging device 3 has a discharging wire stretched in the axial direction L of the electrophotographic photoreceptor 2. In addition, the charging device 3 has a pair of rollers 30. The rollers 30 are made to contact with the inclined annular surfaces 25A of the second regions 25 in the electrophotographic photoreceptor 2 and can rotate while being in contact with the inclined annular surfaces 25A. The rollers have insulation at least on surfaces thereof.

The exposure device 4 illustrated in FIG. 1 serves to form an electrostatic latent image on the electrophotographic photoreceptor 2, and is capable of emitting a laser beam. The exposure device 4 forms an electrostatic latent image by emitting light on the surface of the electrophotographic photoreceptor 2 in response to an image signal and by lowering the electrical potential at the emitted portion.

The development device 5 forms a toner image by developing the electrostatic latent image formed on the electrophotographic photoreceptor 2. The development device 5 holds therein a developer and has a developing sleeve 50.

The developer serves to develop a toner image formed on the surface of the electrophotographic photoreceptor 2, and is frictionally charged at the development device 5. The developer may be a two-component developer of magnetic carrier and insulating toner, or a one-component developer of magnetic toner.

The developing sleeve 50 serves to transfer the developer to a developing area between the electrophotographic photoreceptor 2 and the developing sleeve 50.

In the development device 5, the frictionally charged toner forms a magnetic brush with bristles, each having a predetermined length, and is transferred to the developing area by the developing sleeve 50. On the developing area between the electrophotographic photoreceptor 2 and the developing sleeve 50, the toner image is formed by developing the electrostatic latent image with the toner. When the toner image is formed by a regular developing, the toner image is charged in a reverse polarity of the polarity of the surface of the electrophotographic photoreceptor 2. On the other hand, when the toner image is formed by a reverse developing, the toner image is charged in a same polarity as the polarity of the surface of the electrophotographic photoreceptor 2.

The transfer device 6 transfers the toner image on a recording medium P supplied to a transfer area between the electrophotographic photoreceptor 2 and the transfer device 6. The transfer device 6 includes a transfer charger 60 and a separation charger 61. In the transfer device 6, the rear side (non-recording surface) of the recording medium P is charged in a polarity reversed to that of the toner image by the transfer charger 60, and the toner image is transferred on the recording medium P by the electrostatic attraction between the electrification charge and the toner image. Further, in the transfer device 6, simultaneously with the transfer of the toner image, the rear side of the recording medium P is charged in an alternating polarity by the separation charger 61, so that the recording medium P is quickly separated from the surface of the electrophotographic photoreceptor 2.

As for the transfer device 6, there may be used a transfer roller that is driven with the rotation of the electrophotographic photoreceptor 2 and is spaced from the electrophotographic photoreceptor 2 by a minute gap (generally, not more than 0.5 mm). Such transfer roller applies a transfer voltage for attracting the toner image of the electrophotographic photoreceptor 2 onto the recording medium P by using, e.g., a DC power source. In the case of using the transfer roller, a transfer material separating device such as the separation charger 61 is omitted.

The fixing device 7 serves to fix a toner image transferred on the recording medium P and includes a pair of fixing rollers 70 and 71. In the fixing device 7, the recording medium P is made to pass through between the fixing rollers 70 and 71, so that the toner image can be fixed on the recording medium P by heat, pressure or the like.

The cleaning device 8 serves to remove the toner remaining on the surface of the electrophotographic photoreceptor 2 and includes a cleaning blade 80. In the cleaning device 8, the remaining toner is scraped off the surface of the electrophotographic photoreceptor 2 so as to be collected. The toner collected by the cleaning device 8 is provided to the development device 5 so that it can be reused when necessary.

The discharging device 9 removes any surface charge of the electrophotographic photoreceptor 2. For example, the discharging device 9 is configured to remove the surface charge of the electrophotographic photoreceptor 2 by irradiating light on the surface of the electrophotographic photoreceptor 2.

Figure 8:
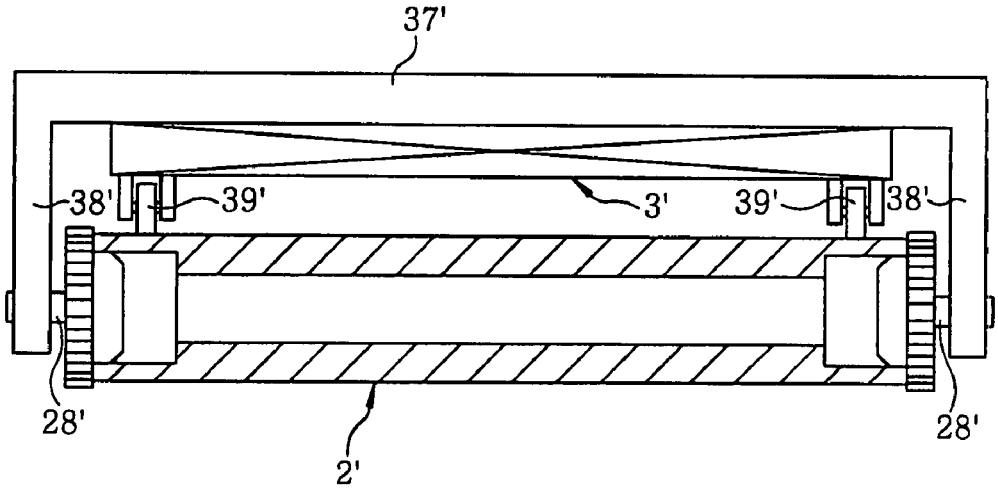
FIG. 8 (RELATED ART)
FIG. 8 illustrates a cross sectional view of principal parts to explain an example of a conventional image forming apparatus.

In the image forming apparatus 1, the positioning between the electrophotographic photoreceptor 2 and the charging device 3 is performed by making the rollers 30 of the charging device 3 serving as one of the processing devices contact with the inclined annular surfaces 25A of the electrophotographic photoreceptor 2. In the image forming apparatus 1, the rollers 30 are made to rotate while being in contact with the inclined annular surfaces 25A, so that the movement of the rollers 30 is appropriately restricted in the axial direction L. Thus, in the image forming apparatus 1, the positional accuracy between the electrophotographic photoreceptor 2 and the charging device 3 can be improved with a simple structure and at a low cost. Moreover, since a large-sized positioning member such as the conventional housing (see the reference numeral 37' of FIG. 8) or the like is not required, the scaling up of the apparatus can be avoided.

The inclined annular surfaces 25A of the electrophotographic photoreceptor 2 have diameters that decrease gradually toward the end surfaces 20A. Accordingly, even when impurities such as abrasive particles and the like are generated by the friction or the like between the rollers 30 of the charging device 3 and the film forming layer 23 (surface layer 23*c*) of the electrophotographic photoreceptor 2, the impurities are usually dispersed toward the flanges 21 of the electrophotographic photoreceptor 2 and are hardly dispersed to be left in the first region 24 where the electrostatic latent image is formed in the electrophotographic photoreceptor 2. As a result, it is possible to effectively suppress the deterioration of the quality of the image by the adhesion of the impurities, e.g., abrasive particles and the like, to the first region 24.

When the film forming layer 23 is made of an a-Si based material, the surface of the film forming layer 23 becomes hard. Thus, even if the electrophotographic photoreceptor 2 is made to rotate while being in contact with the rollers 30 of the charging device 3, it is possible to suppress the generation of the impurities in the film forming layer 23 by the friction or the like. As a consequence, the impurities generated by the friction or the like can be effectively prevented from being dispersed to be left in the first region 24 of the electrophotographic photoreceptor 2, thereby more reducing the deterioration of the quality of the image by the adhesion of the impurities.

Hereinafter, another embodiment of the electrophotographic photoreceptor in accordance with the present invention will be described with reference to FIGS. 4A to 6C.

Figure 4A:
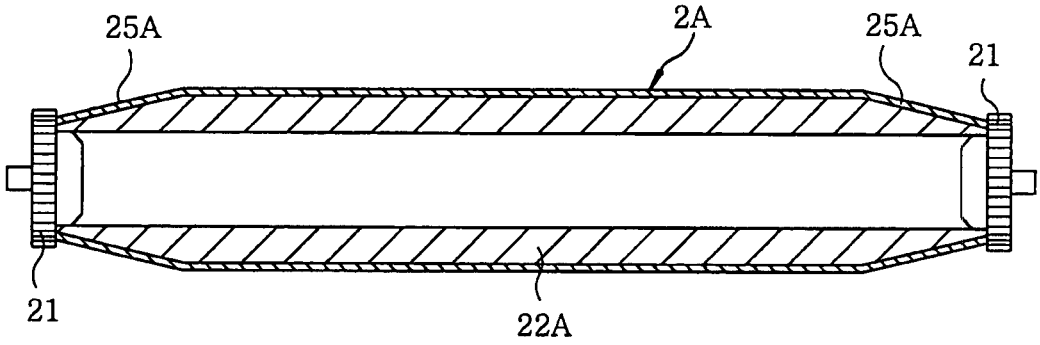
FIGS. 4A to 4C respectively illustrate cross sectional views to explain another example of the electrophotographic photoreceptor in accordance with the present invention.
Figure 4B:
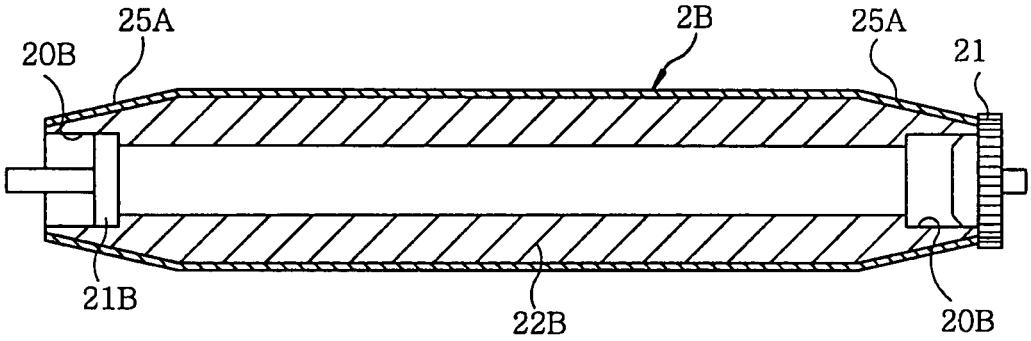
Figure 4C:
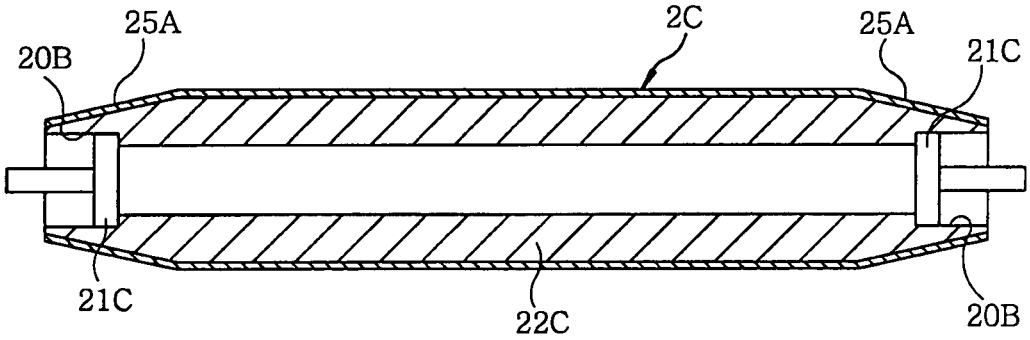

Electrophotographic photoreceptors 2A, 2B and 2C respectively illustrated in FIGS. 4A to 4C have the inclined annular surfaces 25A at both end portions thereof, as in the aforementioned electrophotographic photoreceptor 2 (see FIG. 2). The difference between the electrophotographic photoreceptors 2A to 2C respectively illustrated in FIGS. 4A to 4C and the aforementioned electrophotographic photoreceptor 2 (see FIG. 2) will be described hereinafter.

In the electrophotographic photoreceptor 2A illustrated in FIG. 4A, the spigot joint portions (see the reference numeral 20B illustrated in FIG. 2) are omitted in a cylindrical body 22A, and flanges 21 are insertion-fitted without the spigot joint portions. In the electrophotographic photoreceptor 2B illustrated in FIG. 4B, a flange 21 is insertion-fitted to one of the spigot joint portions 20B in a cylindrical body 22B, whereas a circular plate 21B is insertion-fitted to the other spigot joint portion 20B. In the electrophotographic photoreceptor 2C illustrated in FIG. 4C, circular plates 21C are insertion-fitted to the spigot joint portions 20B provided at both end portions of a cylindrical body 22C.

The electrophotographic photoreceptors 2A to 2C respectively illustrated in FIGS. 4A to 4C have the inclined annular surfaces 25A, as in the aforementioned electrophotographic photoreceptor 2 (see FIG. 2). Therefore, the positioning between the electrophotographic photoreceptors 2A to 2C respectively illustrated in FIGS. 4A to 4C and the charging device 3 (see FIG. 2) can also be performed with a simple structure and at a low cost without scaling up the apparatus. In addition, it is possible to suppress the deterioration of the quality of the image.

Figure 5A:
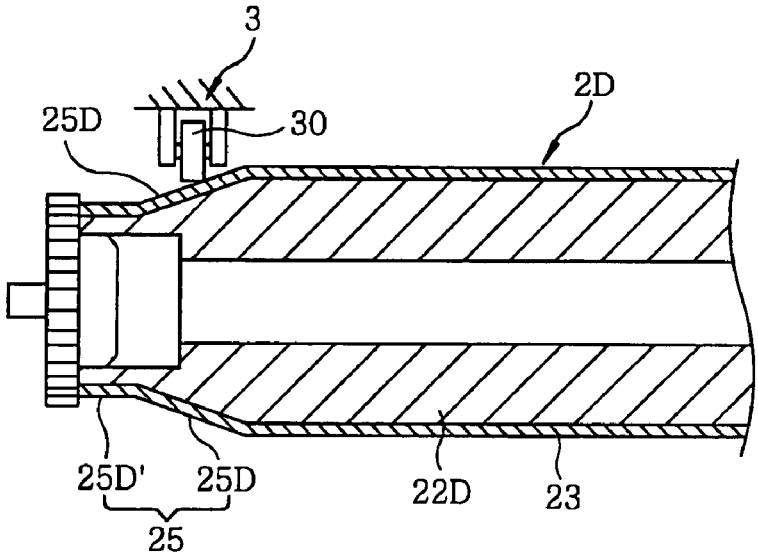
FIGS. 5A and 5B respectively illustrate cross sectional views of principal parts to explain still another example of the electrophotographic photoreceptor in accordance with the present invention.

An electrophotographic photoreceptor 2D illustrated in FIG. 5A has inclined annular surfaces 25D and cylindrical surfaces 25D' at both end portions thereof (the second regions 25). An electrophotographic photoreceptor 2E illustrated in FIG. 5B has upright annular surfaces 25E at both end portions thereof (the second regions 25). The inclined annular surfaces 25D or the upright annular surfaces 25E are made to contact the rollers 30 of the charging device 3 to thereby perform the positioning between the electrophotographic photoreceptor 2D or 2E and the charging device 3. The inclined annular surfaces 25D or the upright annular surfaces 25E of the electrophotographic photoreceptor 2D or 2E can be formed by performing a surface treatment, e.g., grinding, polishing or the like, on the end portions of the cylindrical body 22D or 22E and then forming the film forming layer 23 on the cylindrical body 22D or 22E.

Figure 5B:
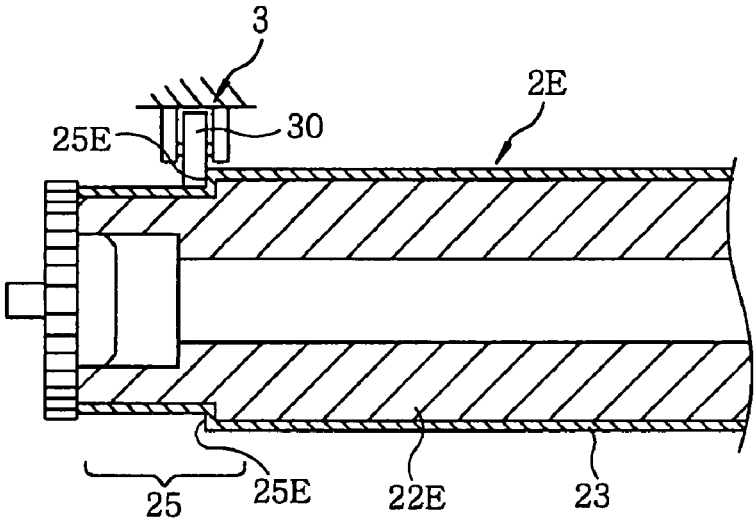

The electrophotographic photoreceptors 2D and 2E respectively illustrated in FIGS. 5A and 5B have the inclined annular surfaces 25D or the upright annular surfaces 25E, both serving a same role as the inclined annular surfaces 25A of the aforementioned electrophotographic photoreceptor 2 in FIG. 2. Therefore, the positioning between the electrophotographic photoreceptors 2D and 2E and the charging device 3 (see FIG. 2) can be performed with a simple structure and at a low cost without scaling up the apparatus. Besides, it is possible to suppress the deterioration in the quality of the image.

Figure 6A:
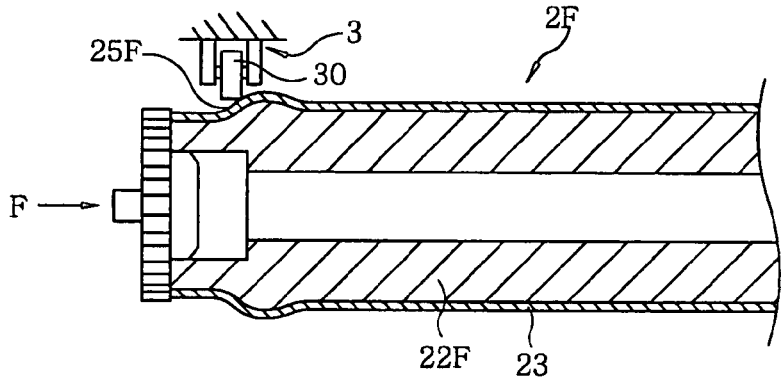
FIGS. 6A to 6C respectively illustrate cross sectional views of principal parts to explain still another example of the electrophotographic photoreceptor in accordance with the present invention.
Figure 6B:
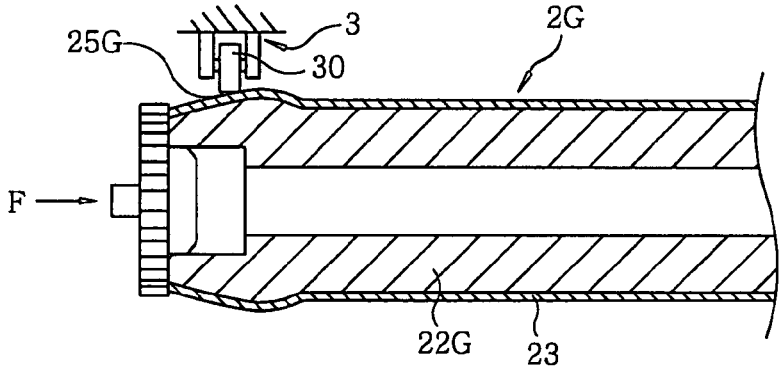
Figure 6C:
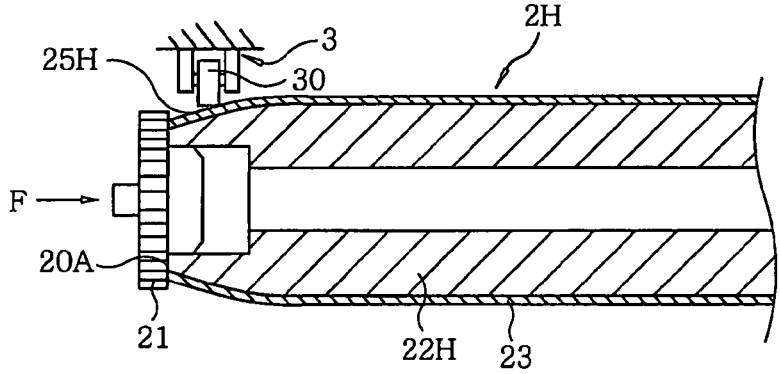

Electrophotographic photoreceptors 2F, 2G and 2H respectively illustrated in FIGS. 6A to 6C have inclined annular surfaces 25F, 25G and 25H, all being formed in a mildly curved shape. To be specific, in the electrophotographic photoreceptors 2F and 2G respectively illustrated in FIGS. 6A and 6B, the inclined annular surfaces 25F and 25G are formed in a mildly curved shape due to the presence of annular shaped protrusions. In the electrophotographic photoreceptor 2H illustrated in FIG. 6C, the inclined annular surfaces 25H are formed in a mildly curved shape by increasing a change rate of the diameter in the end portions toward the end surfaces 20A (the flanges 21).

Although the inclined annular surfaces 25F to 25H of the electrophotographic photoreceptors 2F to 2H respectively illustrated in FIGS. 6A to 6C are formed in a mildly curved shape, the electrophotographic photoreceptors 2F to 2H can be positioned with respect to the charging device 3 by making the inclined annular surfaces 25F to 25H contact with the rollers 30 of the charging device 3. In other words, the positioning can be performed with a simple structure. Further, a positioning member or the like is not required, so that the scaling up of the apparatus can be suppressed.

The inclined annular surfaces 25F to 25H can be formed by respectively applying loads to the cylindrical bodies 22F to 22H after forming the film forming layers 23 on the outer surfaces of the cylindrical bodies 22F to 22H. For example, when the film forming layers 23 are formed on the cylindrical bodies 22F to 22H at high temperatures and are cooled down, loads can be applied to the cylindrical bodies 22F to 22H by using a difference of heat contraction between the cylindrical bodies 22F to 22H and the film forming layers 23. Since the cooling process is generally carried out after the film forming process, a special process is not required in forming the inclined annular surfaces 25F to 25H of the electrophotographic photoreceptors 2F to 2H, which makes it possible to suppress the increase in the manufacturing cost.

The end portions of the cylindrical bodies 22F to 22H can also be transformed by using another method other than the method of cooling the cylindrical bodies 22F to 22H and the film forming layers 23. For example, the end portions thereof can be transformed by applying mechanical loads F from the outside toward the end portions of the cylindrical bodies 22F to 22H in arrow directions illustrated in FIGS. 6A to 6C, respectively. Besides, it is possible to form the electrophotographic photoreceptors 2F to 2H having at both end portions thereof the mildly curved inclined annular surfaces 25F to 25H by forming both end portions of the cylindrical bodies 22F to 22H in mildly curved shapes by performing surface treatments such as cutting, grinding or the like on the cylindrical bodies 22F to 22H and then forming the film forming layers 23 on the surfaces of the cylindrical bodies 22F to 22H.

Figure 7A:
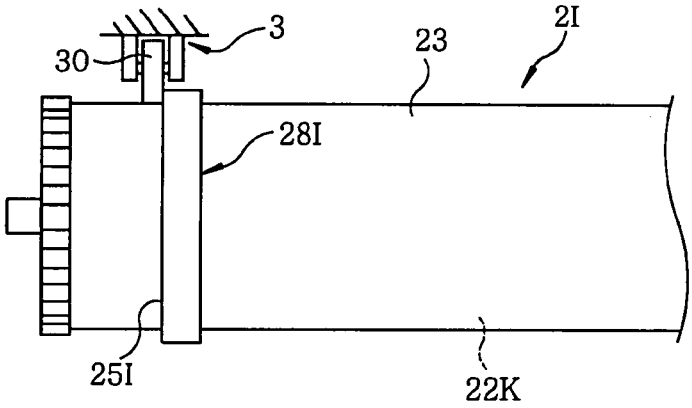
FIGS. 7A to 7C respectively illustrate front views of principal parts to explain still another example of the electrophotographic photoreceptor in accordance with the present invention.
Figure 7B:
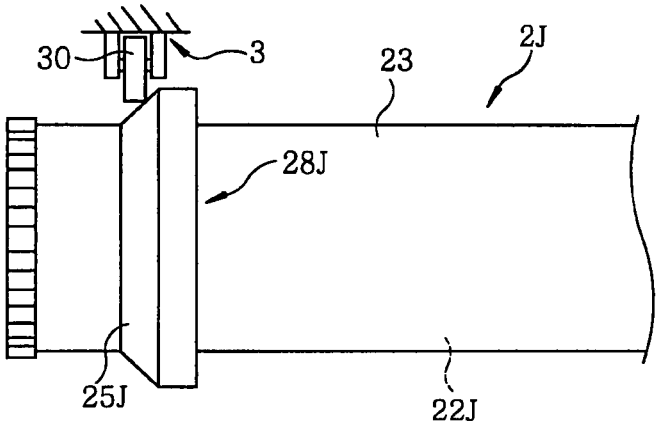
Figure 7C:
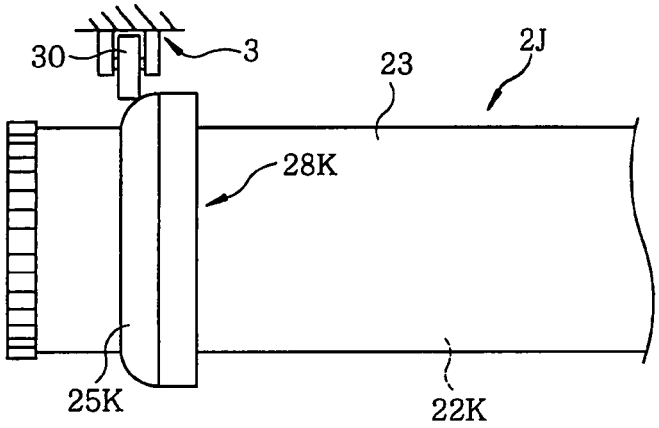

Electrophotographic photoreceptors 2I, 2J and 2K respectively illustrated in FIGS. 7A to 7C are provided with upright annular surfaces 25I or inclined annular surfaces 25J and 25K by fixing ring-shaped members 28I, 28J and 28K around the surface of the film forming layers 23. To be specific, the electrophotographic photoreceptor 2I has the upright annular surfaces 25I by fixing the annular shaped members 28I having a uniform thickness. Meanwhile, the electrophotographic photoreceptors 2J and 2K respectively illustrated in FIGS. 7B and 7C have the inclined annular surfaces 25J formed in a tapered shape and the inclined annular surfaces 25K formed in a mildly curved shape by fixing the annular shaped members 28J and 28K, each having a thickness that decreases from a central portion toward a peripheral portion.

In the electrophotographic photoreceptors 2I to 2K, the annular shaped members 28I to 28K need to be separately formed and then fixed on the surface of the film forming layers 23. However, the conventional manufacturing process for the electrophotographic photoreceptor is not changed. Moreover, the annular shaped members 28I to 28K are manufactured by another process different from the process for manufacturing the cylindrical bodies 22I to 22K or the film forming layers 23, so that shapes or materials of the annular shaped members 28I to 28K can be selected without being restricted by the manufacturing process for the cylindrical bodies 22I to 22K or the film forming layers layer 23. As a result, there are provided a wide range of selection in size or hardness of the upright annular surfaces 25I or the inclined annular surfaces 25J and 25K and, hence, the present invention can be appropriately applied to different electrophotographic photoreceptors employed in various devices.

The present invention can be variously modified without being limited to the above-described embodiments. In the aforementioned example, the image forming apparatus in accordance with the present invention is applied to the relationship between the electrophotographic photoreceptor 2 and the charging device 3 serving as the processing device. However, the present invention can also be applied to a relationship between the electrophotographic photoreceptor 2 and another processing device, e.g., the development device 5 (developing sleeve 50) or the like.

In accordance with the embodiments of the present invention, the contact portions of the processing device are made to contact with the inclined annular surfaces or the upright annular surfaces of the electrophotographic photoreceptor in order to perform the positioning between the electrophotographic photoreceptor and the processing device. Therefore, the positional accuracy between the electrophotographic photoreceptor and the processing device can be improved with a simple structure and at a low cost. Moreover, space efficiency of the apparatus is improved because a large-sized positioning member, e.g., the conventional housing (see reference numeral 37' of FIG. 8) or the like is not needed. As a consequence, the scaling up of the apparatus can be effectively avoided.

Figure 9:
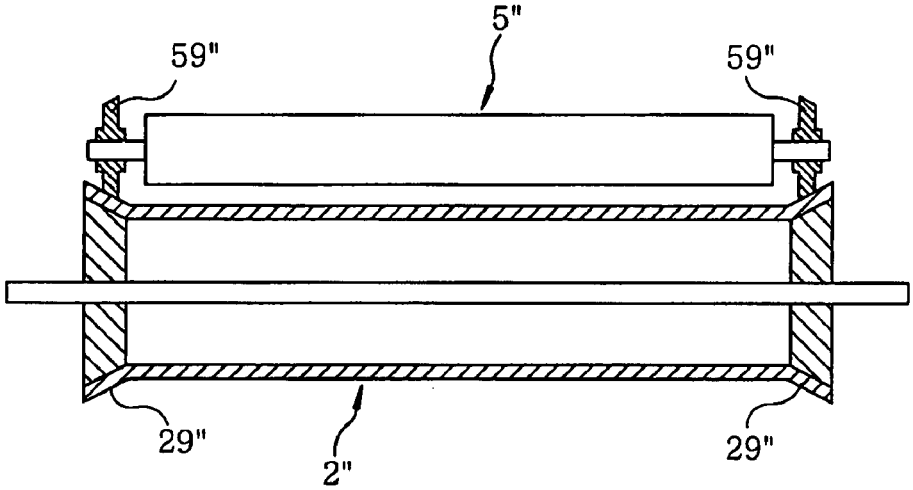
FIG. 9 (RELATED ART)
FIG. 9 illustrates a cross sectional view of principal parts to explain another example of the conventional image forming apparatus.

The inclined annular surfaces are formed so that respective diameters decrease gradually toward the end portions of the electrophotographic photoreceptor. Thus, even when impurities such as abrasive particles and the like are generated by friction or the like between the contact portions of the processing device and the outer surface of the electrophotographic photoreceptor, the impurities are usually dispersed toward the end portions of the electrophotographic photoreceptor and are hardly dispersed in the first region of the electrophotographic photoreceptor where an electrostatic latent image is formed, in contrast with the structure provided in the conventional tapered portions (see reference numeral 29" of FIG. 9). Similarly, the upright annular surfaces can also suppress the dispersion of the impurities in the first region. As a result, the deterioration of the quality of the image by the impurities such as abrasive particles and the like can be effectively suppressed.

When the film forming layer is formed of amorphous silicon, the surface of the film forming layer becomes hard.

Accordingly, even if the electrophotographic photoreceptor is made to rotate while being in contact with the contact portions of the processing device, it is possible to effectively suppress the generation of impurities in the film forming layer by the friction or the like. As a result, the impurities generated by the friction or the like can be effectively prevented from being dispersed to thereby be left in the first region, thereby more reducing the deterioration of the quality of the image.

The positioning between the electrophotographic photoreceptor and the processing device of which positional accuracy greatly affects the quality of the image can be appropriately performed by making the contact portions of the charging device or the development device contact with the inclined annular surfaces or the upright annular surfaces of the electrophotographic photoreceptor in order to perform. As a result, the deterioration of the quality of the image can be effectively avoided.

The inclined annular surfaces or the upright annular surfaces of the electrophotographic photoreceptor can be formed by performing a surface treatment, e.g., cutting, grinding, polishing or the like, on the end portions of the cylindrical body and then forming the film forming layer on the cylindrical body. Since the inclined annular surfaces or the upright annular surfaces of the electrophotographic photoreceptor can be formed only by performing the surface treatment required for manufacturing the cylindrical body, it is possible to effectively suppress the increase in operational and manufacturing cost required for forming the inclined annular surfaces or the upright annular surfaces.

When the inclined annular surfaces or the upright annular surfaces are provided with annular shaped members fitted around the outer surface of the film forming layer, an additional process is required to form the inclined annular surfaces or the upright annular surfaces, whereas the conventional manufacturing process for the electrophotographic photoreceptor is not changed. Moreover, the annular shaped members are manufactured by another process different from the process for manufacturing the cylindrical body or the film forming layer, so that shapes or materials of the annular shaped members can be selected without being restricted by the manufacturing process for the cylindrical body or the film forming layer. As a result, there are provided a wide range of selection in size or hardness of the inclined annular surfaces or the upright annular surfaces and, hence, the present invention can be appropriately applied to different electrophotographic photoreceptors employed in various devices.

While the invention has been shown and described with respect to the embodiments, it will be understood by those skilled in the art that various changes and modification may be made without departing from the scope of the invention as defined in the following claims.

What is claimed is:

1. An electrophotographic photoreceptor comprising:

a cylindrical body; and a film forming layer formed on an outer surface of the cylindrical body and having a photosensitive layer, wherein the electrophotographic photoreceptor is divided into a first region where an electrostatic latent image is formed and second regions provided at both end portions in an axial direction of the cylindrical body, wherein the cylindrical body includes annular protrusions which are formed in the second regions and have outer diameters larger than an outer diameter of the cylindrical body in the first region, wherein the film forming layer in the second regions includes inclined annular surfaces whose outer diameters decrease toward end portions in the axial direction, and wherein the inclined annular surfaces are formed in a curved shape due to the presence of the annular protrusions of the cylindrical body.

2. The electrophotographic photoreceptor of claim 1, wherein the film forming layer is formed of amorphous silicon.

3. An image forming apparatus comprising:

the electrophotographic photoreceptor of claim 1; and a processing device arranged around the electrophotographic photoreceptor, wherein the processing device includes rollers contacting with the inclined annular surfaces of the electrophotographic photoreceptor to maintain a position of the electrophotographic photoreceptor with respect to the processing device, and wherein the processing device is a charging device configured to charge an outer surface of the electrophotographic photoreceptor.

* * * * *